United States Patent [19]

Ulrich, Sr.

[11] Patent Number: 5,057,983

[45] Date of Patent: Oct. 15, 1991

[54] EMERGENCY LIGHTING APPARATUS WITH MOVABLE PROTECTIVE SHIELD ADAPTED FOR USE WITH MOVABLE ENVIRONMENTAL STRUCTURE

[75] Inventor: Ray R. Ulrich, Sr., Trenton, N.J.

[73] Assignee: Rudy's Armature Service, Inc., Rahway, N.J.

[21] Appl. No.: 553,049

[22] Filed: Jul. 16, 1990

[51] Int. Cl.[5] ..... F21V 1/00; F21V 17/02

[52] U.S. Cl. ..... 362/276; 362/61; 362/263; 362/322

[58] Field of Search ..... 362/61, 263, 276, 277, 362/322

[56] References Cited

U.S. PATENT DOCUMENTS

| | | | |
|---|---|---|---|
| 1,482,794 | 2/1924 | Holtsinger | 362/61 |
| 1,510,678 | 10/1924 | Jory | 362/276 |
| 1,513,848 | 11/1924 | Moore | 362/61 |
| 1,774,413 | 8/1930 | Bendixen . | |
| 1,930,738 | 10/1933 | Bergenson | 362/61 |
| 2,633,549 | 3/1953 | King | 362/276 X |
| 4,443,834 | 4/1984 | Schäfer et al. | 362/280 |
| 4,796,169 | 1/1989 | Shemitz et al. | 362/282 |
| 4,827,383 | 5/1989 | Karas | 362/61 |
| 4,870,551 | 9/1989 | Nagel | 362/263 |
| 4,931,766 | 6/1990 | Bernard et al. | 362/263 X |

*Primary Examiner*—Stephen F. Husar
*Assistant Examiner*—Peggy A. Neils
*Attorney, Agent, or Firm*—Sperry, Zoda & Kane

[57] ABSTRACT

An emergency lighting apparatus designed for attachment with respect to a movable environmental structure such as a vertically movable dump body of a truck which is movable between a raised position and a down position wherein the emergency light includes a light shield pivotally movable with respect to the housing of the light responsive to gravitational force exerted therein to continuously shield the light from passing directly downwardly therefrom to prevent excessive glare being experienced by the truck driver when located in an area immediately adjacent to the truck cab. The light shield may include an opaque section to facilitate the light shading and may include an auxiliary weight secured with respect thereto to maintain proper orientation of the light shield with respect to the housing of the light during movement of the dump body of the truck between the raised and down positions. The light shield may be pivotally secured for restricted rotational movement with respect to the lens of the light fixture.

16 Claims, 2 Drawing Sheets

FIG. 1
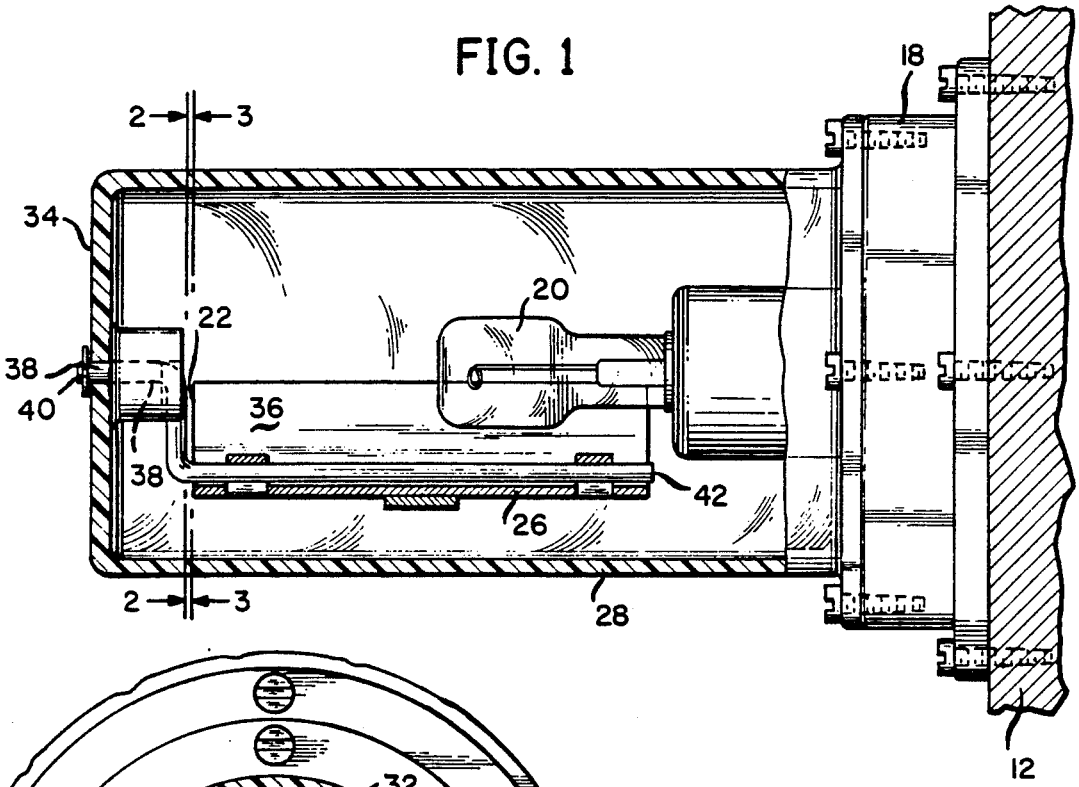
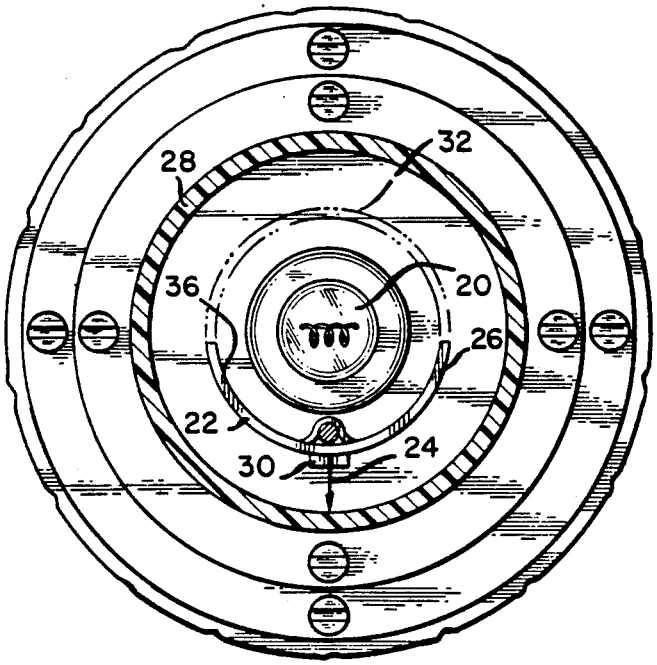
FIG. 2
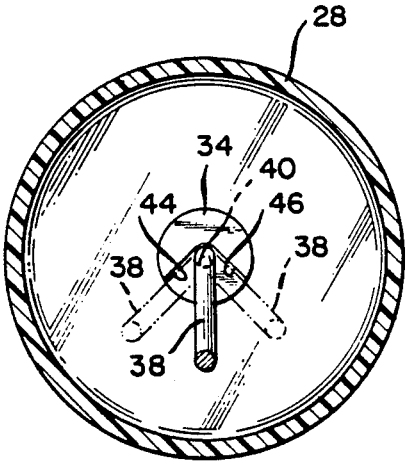
FIG. 3

EMERGENCY LIGHTING APPARATUS WITH MOVABLE PROTECTIVE SHIELD ADAPTED FOR USE WITH MOVABLE ENVIRONMENTAL STRUCTURE

BACKGROUND OF THE INVENTION

1. Field Of The Invention

The present invention deals with the field of lighting apparatus used for emergency lighting situations such as strobe lights and the like. It is conventional that such emergency lighting fixtures are secured with respect to the dump body of dump trucks used in many useful applications and particularly usable in care and service of highways and nearby areas.

With the emergency lighting extending outwardly from dump bodies a driver located in the cab of a truck may look upwardly to try to orient the dump body as required in the fully raised position or the fully down position or some intermediate position. The emergency lighting or strobe lighting fixtures tend to be extremely bright thereby providing excessive glare into the eyes of the driver when trying to properly orient the dump body. The invention of the present application provides a means for preventing this glare being generated from the emergency light attached to the dump body regardless of the vertical height of the position of the dump body.

2. Description Of The Prior Art

Numerous devices have been patented in the prior art for such emergency lighting configurations such as U.S. Pat. No. 1,482,794 patented Feb. 5, 1924 to F. A. Holtsinger on a Headlight Shade; U.S. Pat. No. 1,513,848 patented Nov. 4, 1924 to A. Moore on an Antiglare Device For Headlights; U.S. Pat. No. 1,930,738 patented Oct. 17, 1933 to S. R. F. Bergenson on a Headlight; U.S. Pat. No. 4,443,834 issued Apr. 17, 1984 to H. Schafer et al on an Interior Lighting For Vehicles With Rotatable Mask; U.S. Pat. No. 4,796,169 issued Jan. 3, 1989 to S. Shemitz on a Lighting Fixture With Rotatable Glareshield; and U.S. Pat. No. 4,827,383 issued May 2, 1989 to M. Karas on a Self-Adjusting Headlight System For Vehicles.

SUMMARY OF THE INVENTION

The present invention provides an emergency lighting apparatus for use with a movable shield adapted to be attached with respect to a movable environmental structure such as a dump body of a dump truck which itself is movable between a raised position and a down position. The lighting apparatus preferably includes a light housing fixedly secured with respect to the dump body to be movable therewith. A lighting means such as an incandescent or fluorescent bulb, flash tube or other powered light providing emergency warnings or strobe signals may be detachably secured with respect to the light housing to be movable therewith. The light itself is often removable from the housing to facilitate bulb replacement. The light is adapted to generate light to pass outwardly from the light housing as desired in the direction chosen. The light is selectively removable to facilitate change of wattage thereof or to facilitate replacement and maintenance thereof.

A lens being preferably of cylindrical configuration defines a top area thereon and is adapted to be secured fixed with respect to the light housing in such a manner as to extend over the light for protection thereof and to control light extending outwardly therefrom. The lens preferably defines a first and second stop means thereon.

A movable light shield is pivotally movable with respect to the top area of the lens responsive to movement of the light housing. Movement of the light shield responsive to movement of the light housing is powered by gravitational force exerted downwardly thereon. Preferably the light shield includes an opaque section defined thereon to prevent passing of light therethrough. This opaque section is preferably movable responsive to gravitational force exerted thereon to prevent passing of light from the light means downwardly through the lens. A reflective surface may be defined on the inside of the opaque section adjacent the lighting device in such a manner as to be adapted to facilitate the generation of light therefrom in the desired direction. An arm means may be included fixedly secured with respect to the opaque section and pivotally mounted with respect to the lens. In this manner the arm is movable between a position in abutment with respect to the first stop means and in a position in abutment with respect to the second stop means to thereby restrict the rotational movement of this arm with respect to the lens to an angle of somewhat less than 90 degrees.

An auxiliary weighting fixture may be secured with respect to the movable light shield to facilitate pivotal movement thereof to the desired orientation to prevent transmission of light downwardly from the lighting means responsive to movement of the light housing means and the environmental structure to which it is attached.

The emergency lighting apparatus may further include a light shielding means having an opaque section as well as a transmissive section such as to allow light to emanate outwardly therefrom in a desired direction and to prevent light from emanating outward therefrom in the non-selected directions.

It is an object of the present invention to provide an emergency lighting apparatus with movable protective shielding means adapted for use with movable environmental structure wherein maintenance costs are minimized.

It is an object of the present invention to provide an emergency lighting apparatus with movable protective shielding means adapted for use with movable environmental structure wherein initial capital outlay costs are minimized.

It is an object of the present invention to provide an emergency lighting apparatus with movable protective shielding means adapted for use with movable environmental structure wherein down time is minimized.

It is an object of the present invention to provide an emergency lighting apparatus with movable protective shielding means adapted for use with movable environmental structure wherein protection from external conditions such as weather conditions is achieved.

It is an object of the present invention to provide an emergency lighting apparatus with movable protective shielding means adapted for use with movable environmental structure wherein a shielding means is provided for preventing light from the emergency light from presenting excessive glare conditions to certain prespecified locations.

It is an object of the present invention to provide an emergency lighting apparatus with movable protective shielding means adapted for use with movable environmental structure wherein use thereof mounted fixedly to a dump body of a truck prevents glare from entering the eyes of the truck driver.

It is an object of the present invention to provide an emergency lighting apparatus with movable protective shielding means adapted for use with movable environmental structure being usable in association with the dump body of a truck wherein the dump body is moved between a raised position and a down position such that the shielding means shades excessive glare from in the eyes of a truck driver.

It is an object of the present invention to provide an emergency lighting apparatus with movable protective shielding means adapted for use with movable environmental structure wherein gravitational force is used to urge a light shielding means to prevent glare from being generated directly downwardly from the lighting fixture.

It is an object of the present invention to provide an emergency lighting apparatus with movable protective shielding means adapted for use with movable environmental structure wherein adaption of the currently used lighting fixtures can be achieved merely by the replacement of the lens configuration thereof with a lens configuration including the weighted shielding means of the present invention.

It is an object of the present invention to provide an emergency lighting apparatus with movable protective shielding means adapted for use with movable environmental structure wherein a light protective shield remains level regardless of the angle of a truck body for an emergency light secured with respect to a movable dump body.

It is an object of the present invention to provide an emergency lighting apparatus with movable protective shielding means adapted for use with movable environmental structure wherein light generation is enhanced in the forward and rear direction due to a reflective surface on the downward light shielding means.

It is a object of the present invention to provide an emergency lighting apparatus with movable protective shielding means adapted for use with movable environmental structure wherein a self-leveling light shield is provided.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a side cross-sectional view of an embodiment of an embodiment of the emergency lighting apparatus of the present invention;

FIG. 2 is a cross-sectional view of the embodiment shown in FIG. 1 along lines 2—2 with an alternative embodiment including the transmissive section included in dotted outline thereon;

FIG. 3 is a cross-sectional view of the embodiment shown in FIG. 1 along lines 3—3.

DETAILED DESCRIPTION OF THE PREFERRED EMBODIMENT

Figure 4:
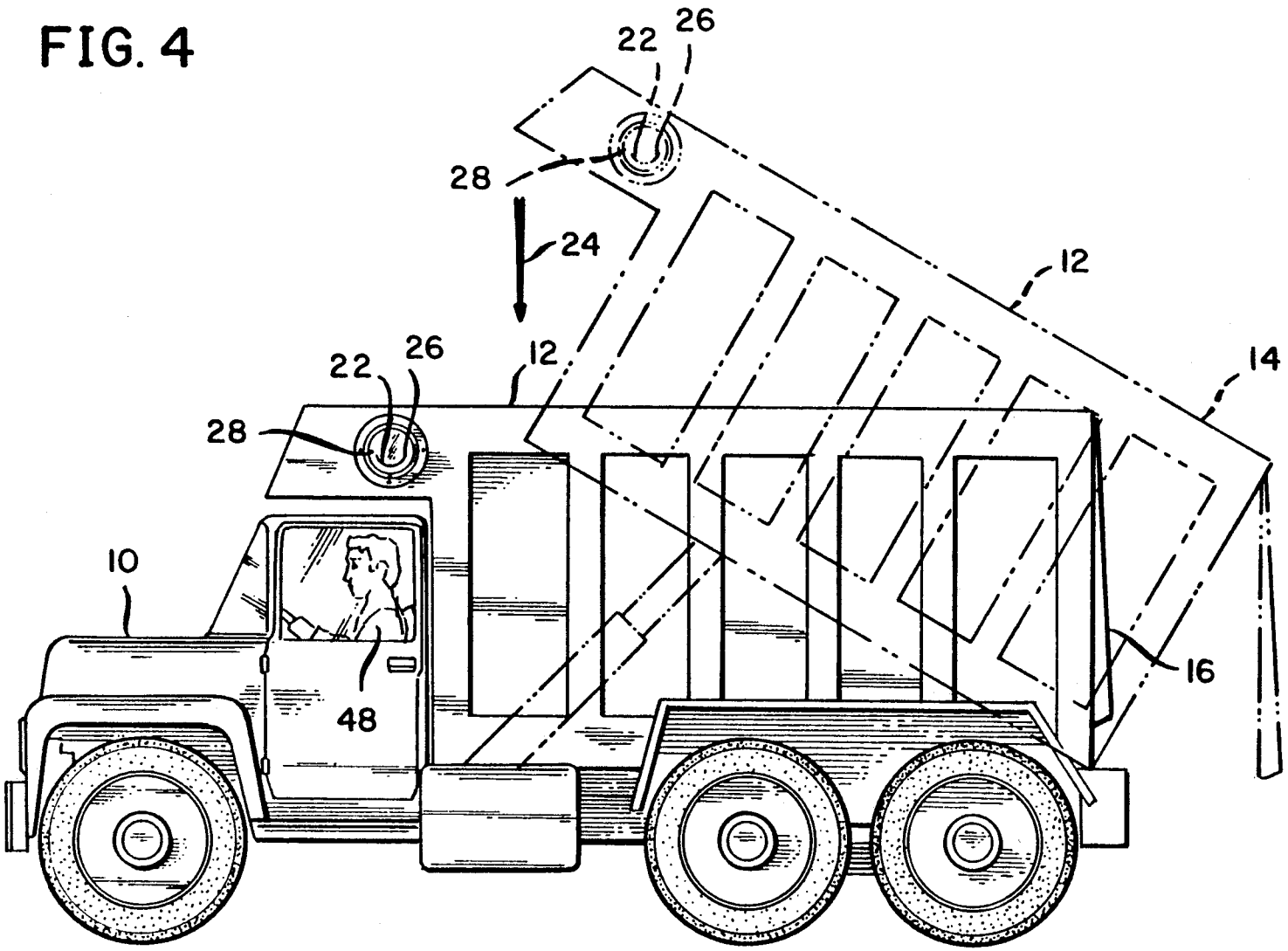
FIG. 4 is a schematic illustration showing a truck with the dump body in the down position in full lines and the raised position in dotted outline with an embodiment of the emergency lighting apparatus secured thereto.

The present invention provides an emergency lighting apparatus for use as shown in FIG. 4 with a truck 10 having a dump body 12 movably secured thereto. The dump body 12 is movable between a raised position 14 and a down position 16 back and forth therebetween.

The emergency lighting apparatus includes a light housing 18 adapted for securement with respect t movable environmental structure such as dump body 12. Light housing 18 includes a lighting means 20 detachably mounted therein. Light 20 such as a flash tube or the like may be adapted to be removable with respect to the light housing 18 to facilitate replacement of bulbs or whatever lighting fixture is used mounted within light housing 18. Also lighting means 20 is removable with respect to light housing 18 to facilitate changing of the wattage or type of lighting device mounted therein as desired.

A light shielding means 22 is movably mounted with respect to light housing 18. Preferably light shield 22 is pivotally movable with respect to a cylindrical lens means 28. Preferably lens means 28 is fixedly secured with respect to the light housing 18 such as to extend over the light 20 to facilitate protection thereof and to control the light emanating therefrom. Light shield 22 is being movable with respect to light housing 18 is preferably driven for pivotal movement by gravitational force shown being exerted in a downward direction by arrow 24.

The light shield 22 preferably includes an opaque section 26 to facilitate prevention of the transmission of light therethrough. The light shield 22 may also include a transmissive section 32 such as shown in dotted outline in FIG. 2 which allows transmission of light therethrough in the pre-chosen desired direction and prevents transmission of light therethrough in the adjacently positioned opaque section. Also a reflecting surface 36 may be defined on the inner surface of the opaque section 26 to further facilitate the transmission and re-transmission of light in the pre-chosen desired directions other than through the opaque section 22.

In the preferred orientation the light shield 22 is pivotally mounted with respect to the top section 34 of lens 28. Top section 34 preferably includes a first stop means 44 and a second stop means 46. Also an arm means 38 is included to facilitate movement of the light shield 22 throughout the pivotal movement thereof over a prechosen restricted angle. The arm means 38 itself is movable between a first stop means 44 and a second stop means 46 to achieve this pivotal movement. The arm means preferably includes a first end 40 mounted with respect to the top section 34 of lens 28 and a second end 42 fixedly secured with respect to the light shield 22 itself.

To control the exertion of gravitational force in the direction 24 with respect to the light shield 22 an auxiliary weighting means 30 as shown best in FIG. 2 may be included fixedly secured with respect to the pivotally movable light shield 22. In this manner more accurate control of the orientation of light shield 22 with respect to the lighting means 20 will be achieved responsive to the exertion of gravitational force thereon.

In operation when attached to a dump body 12 of a truck 10 the emergency lighting apparatus of the present invention will continuously shield and prevent the transmission of light downwardly from the emergency lighting apparatus as shown best in FIG. 4. FIG. 4 shows the dump body 12 of truck 10 in the down position 16 in solid line. With this configuration the light shield 22 will be in the orientation shown in FIG. 2 with the light shield preventing glare from the lighting means 20 from being transmitted downwardly into the eyes of the driver 48. On the other hand as the truck dump body 12 is moved upwardly the light housing 18 will be tend to rotate slightly in a clockwise direction as shown in FIG. 4. The weight of the light shield 22 and also if used the weight of the auxiliary weighting means 30 will urge the light shield 22 to rotate slightly counterclockwise with respect to the lens 28 thereby maintaining the opaque section 26 of the light shield immediately below the lighting means 20. In this manner glare will still be prevented from passing into the eyes of the driver 48 because the weight of light shield 22 will hold it in a position directly below the lighting means 20 preventing transmission of light downwardly therefrom.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An emergency lighting apparatus with movable shielding means for use with movable environmental structure, said emergency lighting apparatus comprising:

a) a light housing means fixedly secured with respect to the environmental structure to be movable therewith;

b) a lighting means detachably secured with respect to said light housing means to be movable therewith, said lighting means adapted to generate light emanating from said light housing means as desired; and c) a movable light shielding means being pivotally movable with respect to said light housing means responsive to movement of said light housing means, movement of said light shielding means responsive to movement of said light housing means being powered by gravitational force exerted downwardly directly upon said movable light shielding means itself, said light shielding means being at least partially opaque to facilitate shading of light passing therethrough, said movable light shielding means comprising a weighting means to facilitate pivotal movement thereof for preventing the transmission of light as desired.

2. An emergency lighting apparatus with movable shielding means for use with movable environmental structure as defined in claim 1 further including a lens means detachably secured with respect to said light housing means and extending over said lighting means to facilitate protection thereof.

3. An emergency lighting apparatus with movable shielding means for use with movable environmental structure as defined in claim 2 wherein said movable light shielding means is pivotally attached with respect to said lens means.

4. An emergency lighting apparatus with movable shielding means for use with movable environmental structure as defined in claim 1 wherein said light shielding means is completely opaque to eliminate transmission of light therethrough.

5. An emergency lighting apparatus with movable shielding means for use with movable environmental structure as defined in claim 1 wherein said lighting means is selectively removable to facilitate replacement thereof as desired.

6. An emergency lighting apparatus with movable shielding means for use with movable environmental structure as defined in claim 1 wherein said light shielding means includes an opaque section and a transmissive section to facilitate control of lighting and shading by said light shielding means.

7. An emergency lighting apparatus with movable shielding means for use with movable environmental structure as defined in claim 2 wherein said lens means is generally cylindrical in shape.

8. An emergency lighting apparatus with movable shielding means for use with movable environmental structure as defined in claim 7 wherein said cylindrical lens means includes a top section defined thereon.

9. An emergency lighting apparatus with movable shielding means for use with movable environmental structure as defined in claim 8 wherein said light shielding means is at least partially rotatably movably secured with respect to said top section of said cylindrical lens means.

10. An emergency lighting apparatus with movable shielding means for use with movable environmental structure as defined in claim 1 wherein said light shielding means includes a reflecting surface on the side thereof adjacent said lighting means to facilitate generation of light therefrom in the desired direction.

11. An emergency lighting apparatus with movable shielding means for use with movable environmental structure as defined in claim 2 wherein said light shielding means includes an arm means with one fixedly secured with respect thereto, said arm means having the other end thereof attached with respect to said lens means.

12. An emergency lighting apparatus with movable shielding means for use with movable environmental structure as defined in claim 1 wherein said light shielding means is rotatably movable with respect to said lens means through an angle of approximately ninety degrees.

13. An emergency lighting apparatus with movable shielding means for use with movable environmental structure was defined in claim 1 wherein said lighting means is a flash tube.

14. An emergency lighting apparatus with movable shielding means for use with movable environmental structure as defined in claim 1 wherein said lighting means comprises a strobe warning light.

15. An emergency lighting apparatus with movable shielding means for use with movable environmental structure, said emergency lighting apparatus comprising:

a) a light housing means fixedly secured with respect to the environmental structure to be movable therewith;

b) a lighting means comprising an emergency warning light being detachably secured with respect to said light housing means to be movable therewith, said lighting means adapted to generate light emanating from said light housing means as desired, said lighting means being selectively removable to facilitate replacement thereof as desired;

c) a lens means being cylindrical and defining a top area thereon, said lens means being detachably secured with respect to said light housing means and extending over said lighting means to facilitate protection thereof, said lens means defining a first stop means and a second stop means thereon;

d) a movable light shielding means being pivotally movable with respect to said top area of said lens means responsive to movement of said light housing means, movement of said light shielding means responsive to movement of said light housing means being powered by gravitational force exerted downwardly directly upon said movable light shielding means itself, said light shielding means including:

(1) an opaque section defined thereon to prevent passing of light therethrough, said opaque section of said light shielding means being movable responsive to gravitational force exerted directly upon said movable light shielding means itself to prevent passing of light from said lighting means downwardly through said lens means said opaque section of said movable light shielding means comprising a weighting means to facilitate pivotal movement thereof for preventing transmission of light as desired;

(2) a reflecting surface defined on the inside of said opaque section adjacent said lighting means adapted to facilitate generation of light therefrom in the desired direction; and (3) an arm means fixedly secured with respect to said opaque section and being pivotally mounted with respect to said lens means for movement between said first stop means and said second stop means to restrict rotational movement of said arm means with respect to said lens means to an angle of less than ninety degrees.

16. An improved movable light shielding means for use with an emergency lighting apparatus attached with respect to movable environmental structure, the emergency lighting apparatus including a light housing fixedly secured with respect to the environmental structure to be movable therewith and a lighting device detachably secured with respect to the light housing to be movable therewith, the lighting device being adapted to generate light emanating from the light housing as desired, the improvement which comprises a movable light shielding means being pivotally movable with respect to said light housing means responsive to movement of said light housing means, movement of said light shielding means responsive to movement of said light housing means being powered by gravitational force exerted downwardly directly upon said movable light shielding means itself, said light shielding means being at least partially opaque to facilitate shading of light passing therethrough.

* * * * *